US005667086A

United States Patent [19]

Guerre

[11] Patent Number: 5,667,086

[45] Date of Patent: Sep. 16, 1997

[54] SEALING TOP FOR BOTTLES AND THE LIKE

[75] Inventor: Joaquin Junqueras Guerre, Ripollet, Spain

[73] Assignee: Formas Tecnicas, S.A., Ripollet, Spain

[21] Appl. No.: 701,102

[22] Filed: Aug. 21, 1996

Related U.S. Application Data

[63] Continuation of Ser. No. 248,429, May 24, 1994, abandoned.

[30] Foreign Application Priority Data

May 31, 1993 [ES] Spain ..... 9301179

[51] Int. Cl.[6] ..... B65D 39/00

[52] U.S. Cl. ..... 215/251; 215/256; 220/257

[58] Field of Search ..... 215/251, 254, 215/256, 258; 220/256, 257

[56] References Cited

U.S. PATENT DOCUMENTS 2,954,139 9/1960 Owens ..... 215/256 X 3,850,328 11/1974 Guala ..... 215/252

3,901,403 8/1975 Menke ..... 215/251

4,506,797 3/1985 Bullock, III ..... 215/256

*Primary Examiner*—Stephen Cronin

*Attorney, Agent, or Firm*—Steinberg, Raskin & Davidson, P.C.

[57] ABSTRACT

A sealing top for a bottle which is closed by a stopper and an arrangement for sealing the top of a bottle including a stopper located within the opening of the bottle and a sealing top. The sealing top has a body which constitutes the upper part and a skirt which constitutes the lower part. The body has an open upper part which includes tear lines which define one or more tabs. The skirt is detachably fixed to the body and the skirt is fixed to the neck of the bottle. The sealing top is also fixed to the stopper such that when the sealing top is torn, the skirt remains joined to the stopper.

20 Claims, 2 Drawing Sheets

SEALING TOP FOR BOTTLES AND THE LIKE

This is a continuation of U.S. patent application Ser. No. 08/248,429, filed May 24, 1994 now abandoned.

FIELD OF THE INVENTION

The present invention relates to a sealing top for bottles and the like and an arrangement for sealing the top of a bottle including the same. The use of sealing tops makes it possible to determine by means of a simple, casual visual observation whether or not the bottles or the like are sealed.

BACKGROUND OF THE INVENTION

The use of initial seals to determine the initial inviolability of the contents of bottles or the like is a common practice. It is well known that with bottled and packed drinks, there is an unfortunately all too common risk of fraudulent and improper tampering by third parties between the manufacturer's sealing of the product and before the product reaches the consumer. It is for this specific reason that the tamper proof systems which ensure and guarantee inviolability against such tampering form a known and important aspect of the field of supplying bottled/packed drinks.

Among such systems, it is worth mentioning those which make it possible to determine, in a simple and direct way, whether or not the interior of the bottle or container has been tampered with during the transport and distribution of the product.

One known system comprises sealable bottle tops which make it possible to determine by means of direct visual observation whether or not the bottle or container has been opened since it left the factory.

Various types of bottle sealing tops are currently known, most of them of the type which comprise an opening tab. The tabs are normally defined by perforated lines which make it easier to tear and separate the disposable cap, defining the top, from the skirt thereof which may or may not remain fixed to the neck of the bottle once the top has been unsealed.

These types of tops suffer from known drawbacks, among which it is worth mentioning the following:

- The perforated lines are peripheral, which means opening the top is normally an awkward task.
- It is also usual for these tops to be provided with a single tab, with the attendant drawback that since it is possible for the tab to break mainly due to the weakness of the material of which they are normally made, it can become even more difficult to open the top after breakage of the tab.
- Embodiments of sealable tops with tearable tabs that are separate from the tops may suffer the accidental tearing of the tabs during the normal handling of the bottles and/or containers, giving rise to losses in the sales of the bottled or packed product.
- The environmental problem regarding the pollution created by discarding product is also a factor which must be considered, since the product comprises at least two disposable parts, the cap and the tab.
- Finally, it is worth mentioning that tops currently come in various sizes as a result of the large variety of embodiments of stoppers (alternatively referred to as bottle closing members or caps), making them more expensive and more difficult to produce. This is a common practice among drink manufacturers and bottlers since the exterior of the bottles and/or containers often carry the identification of the manufacturer.

OBJECTS AND SUMMARY OF THE INVENTION

It is an object of the present invention to provide a new and improved sealing top for bottles which overcomes the drawbacks of the prior art.

In order to attain this object, the sealing top in accordance with the invention comprises a cylindrical tubular body which surrounds and engages with at least a part of a cap or other stopper means of the bottle and comprises tear lines. An upper end of the sealing top is open or free, which enables viewing of the top of the stopper means, and tear lines in the sealing top define one or more tabs in an upper part of the sealing top which can be torn for accessing the contents of the bottle. Upon tearing of the tear lines in the upper part of the sealing top, the upper part is easily removable from its engagement with the stopper means.

These characteristics enable the manufacturing costs of the seal to be reduced, since considerably less material is used in its production. At the same time, since it has no closed upper end which impedes viewability of the stopper means (cap), the identification of the bottled product can be determined via the normally existing identification on the closed end of the bottle stopper. These characteristics further enable the top to be opened easily and, as it is provided with more than one tab, enabling the others to be used if one of them inadvertently breaks.

In a preferred embodiment of the sealing top in accordance with the present invention, the sealing top comprises an upper pad or cap, which is free or open at its upper end, a lower pad or skid and means for fixing the skid to the neck of the bottle or container. More particularly, the skirt is fixed to the neck of the bottle or container by means of an inwardly projecting annular rim which directly engages with the neck of the bottle or container.

In this embodiment, the tear lines which define the tabs (two per tab) are arranged axially or inclined relative to the axis of symmetry of the open cap and at least one of the tear lines of each tab meets a peripheral tear line arranged between the open cap (upper part of the sealing top) and the skirt of the top (lower part of the sealing top), enabling the open cap to be easily separated from the skirt. By means of this embodiment, a single piece consisting of the torn away tab and the open cap can be separated by tearing the top.

Advantageously, the tabs form an integral part of the top and do not protrude from the body thereof, making it easier to handle the seals during the various processes of bottling, sealing and handling of the bottles, as well as in the storage of the bottles provided with the corresponding top, as it is more difficult for them to be torn by accident.

Preferably, the tear lines of the sealing top are perforated lines, thereby reducing the production costs of the sealing tops.

Advantageously, the sealing top is fixed to the stopper of a bottle or the like, by the skirt fixing means, in such a way that once the top is tom, the skirt remains joined to the stopper, thus providing indicia of tampering.

This embodiment makes it possible to obtain different sizes and designs of stoppers for bottles, by means of different embodiments of the sealing tops.

The arrangement for sealing a top of a bottle in accordance with the invention comprises stopper means arranged in association with the bottle for closing the bottle; and a substantially tubular sealing top or sleeve including an open upper part surrounding at least part of the stopper means, a lower part affixed to a part of the bottle, first fixing means for detachably fixing the upper part of the sleeve to the lower part of the sleeve, and second fixing means for detachably fixing the lower part of the sleeve to the stopper means such that when the upper part of the sleeve is detached from the stopper means, the lower part of the sleeve remains in engagement with the stopper means and when the stopper means is removed from engagement with the lower part of the sleeve, the lower part of the sleeve remains fixed to the bottle. The upper part of the sleeve may include movement prevention means for preventing the sealing top from moving relative to the stopper means, e.g., projections arranged on an inner surface of the upper part and engaging with the stopper means. The arrangement should also include suitable detachment means for detaching the upper part from the lower part, e.g., a plurality of tabs forming an integral part of the upper part, each of the tabs constituting a pair of spaced tear lines such that the tab is defined between the tear lines. In this manner, if the first fixing means comprise a perforated tear line situated at an interface point between the lower part and the upper part, a substantial portion of the tear lines forming the tabs is arranged parallel to, or possibly at an inclination to, a cylindrical axis of the sealing top whereby at least one of the tear lines forming the tabs meets the peripheral tear line.

In another embodiment of the arrangement for sealing a top of a bottle in accordance with the invention, the substantially tubular sealing top or sleeve includes second fixing means for fixing the lower part of the sleeve to a part of the bottle and the lower part of the sleeve to the stopper means which comprise an annular ring in engagement with the part of the bottle and having a recess receivable of the lower rim of the stopper means such that when the upper part of the sleeve is removed from engagement with the stopper means, the lower part of the sleeve remains in engagement with the stopper means.

BRIEF DESCRIPTION OF THE DRAWING

The following drawings are illustrative of embodiments of the invention and are not meant to limit the scope of the invention as encompassed by the claims.

DETAILED DESCRIPTION OF THE PREFERRED EMBODIMENTS

Figure 1:
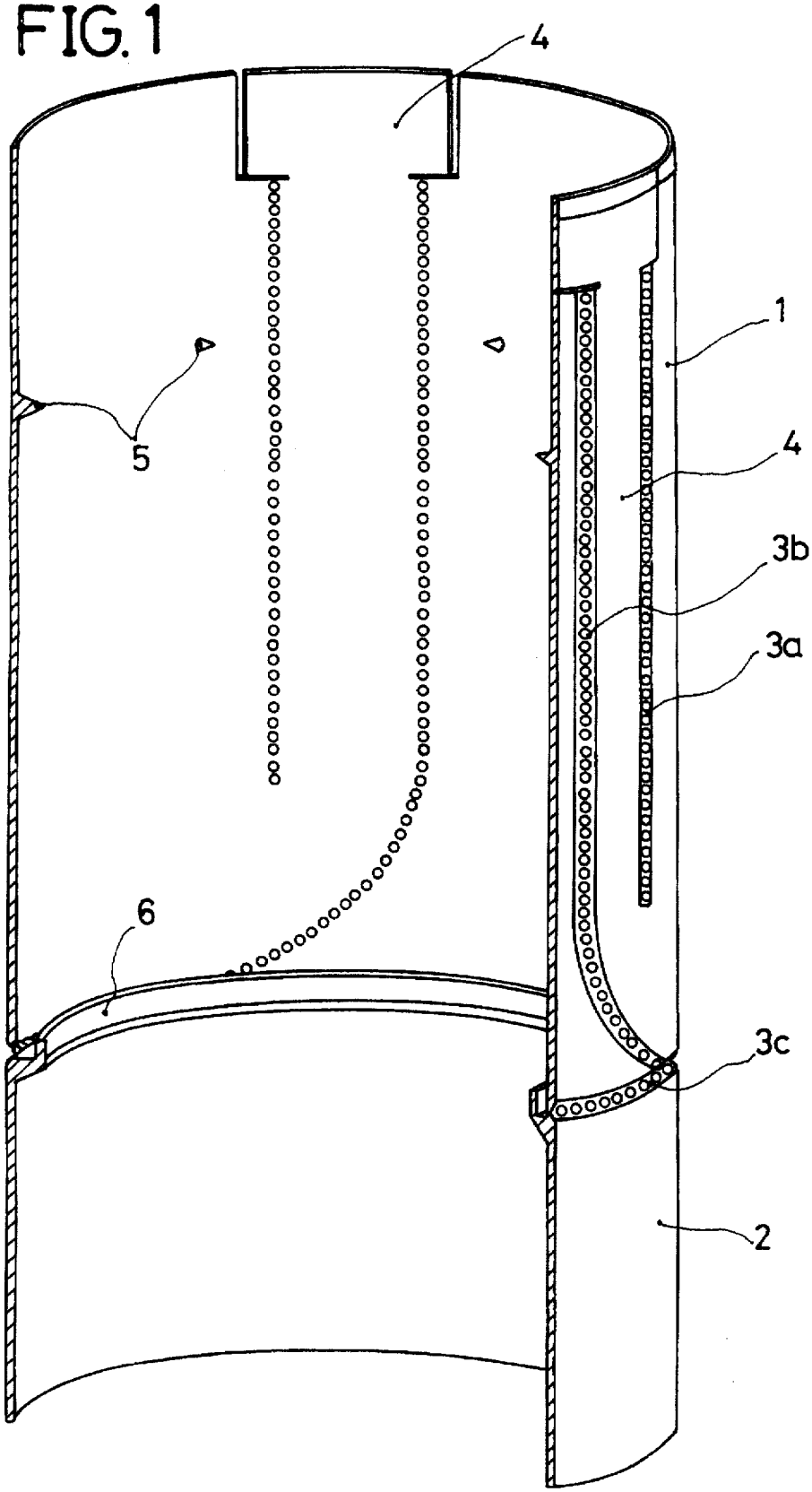
FIG. 1 is a perspective view of the sealing top in accordance with the invention, cut away longitudinally.

Referring to the accompanying drawings wherein like reference numerals refer to the same or similar elements, as shown in FIG. 1, the sealing top in accordance with the invention (also referred to hereinafter as a sleeve) comprises an upper part or cap 1, open at its upper end, and a lower part or skirt 2, the assembly being provided with a plurality of perforated lines 3*a* and 3*b*, pairs of which define a respective one of a plurality of tabs 4. One of the perforated lines 3*b* meets another peripheral perforated tear line 3*c* arranged between the open cap 1 and the skirt 2, i.e., at an interface point therebetween. The sealing top is also provided with piercing securing elements 5 to prevent the sealing top from sliding relative to the stopper.

The lower part of the sealing top or skirt 2 comprises an annular inwardly projecting ring 6 for fixing the sealing top to the different elements of the stopper, as well as for fixing the lower part to a part of the bottle such as the neck of the bottle.

Figure 2:
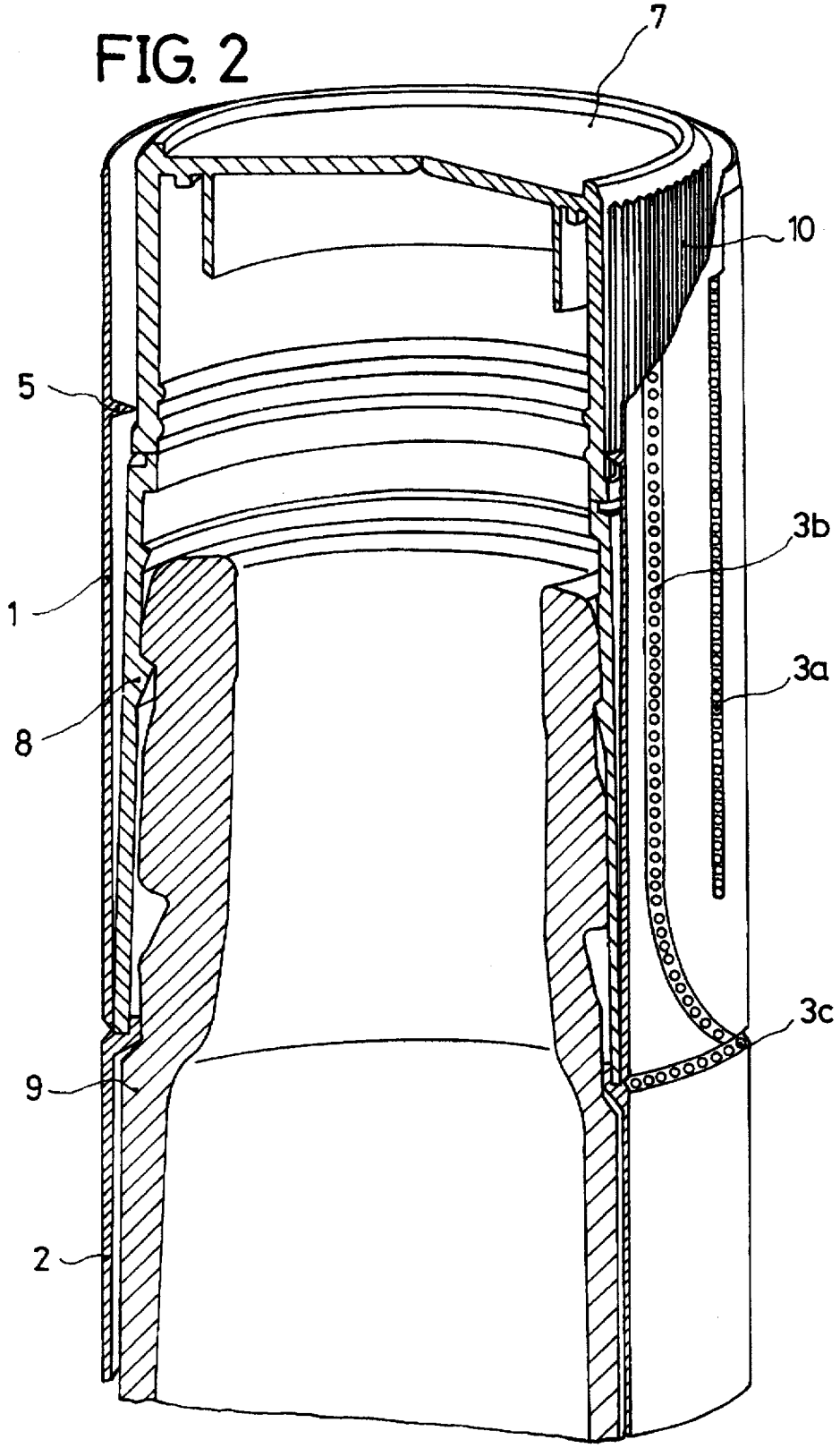
FIG. 2 is a perspective view of the assembly formed by the sealing top, the stopper and the bottle, cut away longitudinally.

FIG. 2 shows the arrangement of the sealing and fixing assembly fitted to a bottle with a stopper, the assembly comprising the open cap 1, the skirt 2, the stopper 7, the skirt of the stopper 8 and the bottle 9. It can also be seen that the securing elements 5 are coupled to, i.e., engage with, grooves 10 on an outer surface of the stopper 7. The inner ring 6 fixes the sealing top by means of the skirt 8 of the stopper 7.

As shown in FIGS. 1 and 2, the sealing top can be easily tom by means of the tabs 4 which are easily accessible at the free end of the open cap. Once the open cap 1 has been torn, the skirt 2 remains joined to the skirt 8 of the stopper 7 forming a single skirt of the desired size and design. The skirts 2,8 may carry names and identification marks drawn or printed thereon to identify the manufacturer, and may be of different sizes or designs.

The materials used in the manufacture of the components of the sealing top, as well as the shapes and dimensions thereof and all other details which may arise are independent of the object of the invention providing they do not affect its basic concept.

The examples provided above are not meant to be exclusive. Many other variations of the present invention would be obvious to those skilled in the art, and are contemplated to be within the scope of the appended claims.

I claim:

1. An arrangement for sealing a top of a bottle, comprising:

stopper means arranged in association with the bottle for closing the bottle; and a substantially tubular sleeve including, an open upper part surrounding at least part of said stopper means, a lower part affixed to a part of the bottle, first fixing means for detachably fixing said upper part of said sleeve to said lower part of said sleeve, and second fixing means for detachably fixing said lower part of said sleeve in engagement with said stopper means such that when said upper part of said sleeve is removed from its position surrounding at least part of said stopper means and detached from said lower part of said sleeve, said lower part of said sleeve remains fixed to said stopper means by said second fixing means and when said stopper means is removed from engagement with said lower part of said sleeve, said lower part of said sleeve remains affixed to the bottle.

2. The arrangement of claim 1, wherein said upper part of said sleeve includes movement prevention means for preventing said sleeve from moving relative to said stopper means, said movement prevention means comprising projections arranged on an inner surface of said upper part of said sleeve and engaging with said stopper means.

3. The arrangement of claim 1, further comprising detachment means for detaching said upper part of said sleeve from said lower part of said sleeve, said detachment means comprising a plurality of tabs forming an integral part of said upper part of said sleeve, each of said tabs constituting a pair of spaced tear lines such that said tab is defined between said tear lines.

4. The arrangement of claim 3, wherein said first fixing means comprise a perforated tear line situated at an interface point between said lower part of said sleeve and said upper part of said sleeve, a substantial portion of said tear lines forming said tabs being arranged parallel to a cylindrical axis of said sleeve whereby at least one of said tear lines forming said tabs meets said peripheral tear line.

5. The arrangement of claim 3, herein said first fixing means comprise a perforated tear line situated at an interface point between said lower part of said sleeve and said upper part of said sleeve, said tear lines forming said tabs being arranged at an inclination to a cylindrical axis of said sleeve whereby only one of said tear lines forming each of said tabs meets said peripheral tear line.

6. The arrangement of claim 1, wherein said first fixing means comprise a perforated tear line situated at an interface point between said lower part of said sleeve and said upper part of said sleeve.

7. The arrangement of claim 1, wherein said second fixing means comprise an inner ring situated at an interface point between said lower part of said sleeve and said upper part of said sleeve.

8. The arrangement of claim 7, wherein said stopper means comprises a cap member having one open end and an opposed end for closing an opening of the bottle, said cap member having a lower cylindrical rim, said inner ring having a cylindrical recess receivable of said lower rim.

9. The arrangement of claim 1, wherein said lower part of said sleeve is arranged to surround and directly engage with a part of the bottle.

10. An arrangement for sealing a top of a bottle, comprising:

stopper means arranged in association with the bottle for closing the bottle, said stopper means having a lower peripheral rim; and a substantially tubular sleeve including, an open upper part surrounding at least part of said stopper means, a lower part, first fixing means for detachably fixing said upper part of said sleeve to said lower part of said sleeve, and second fixing means for detachably fixing said lower part of said sleeve to a part of the bottle and to said stopper means, said second fixing means comprising an annular ring arranged in direct engagement with the part of the bottle and having a recess receivable of said lower rim of said stopper means such that when said upper part of said sleeve is removed from its position surrounding at least part of said stopper means and detached from said lower part of said sleeve, said lower part of said sleeve remains fixed to said stopper means by said second fixing means and when said stopper means is removed from engagement with said lower part of said sleeve, said lower part of said sleeve remains affixed to the bottle by said second fixing means.

11. The arrangement of claim 10, wherein said upper part of said sleeve includes movement prevention means for preventing said upper part of said sleeve from moving relative to said stopper means, said movement prevention means comprising projections arranged on an inner surface of said upper part of said sleeve and engaging with said stopper means.

12. The arrangement of claim 10, wherein said first fixing means comprises a plurality of tabs forming an integral part of said upper part of said sleeve, each of said tabs constituting a pair of spaced tear lines such that said tab is defined between said tear lines.

13. The arrangement of claim 12, wherein said first fixing means comprise a perforated tear line situated at an interface point between said lower part of said sleeve and said upper part of said sleeve, a substantial portion of said tear lines forming said tabs being arranged parallel to a cylindrical axis of said sleeve whereby at least one of said tear lines forming said tabs meets said peripheral tear line.

14. The arrangement of claim 10, wherein said first fixing means comprise a perforated tear line situated at an interface point between said lower part of said sleeve and said upper part of said sleeve.

15. The arrangement of claim 10, wherein said annular ring is situated at an interface point between said lower part of said sleeve and said upper part of said sleeve.

16. A tamper-proof sleeve for a bottle which is closed by a stopper, comprising:

an open upper part surrounding at least part of said stopper, a lower part affixed to a part of the bottle, first fixing means for detachably fixing said upper part of said sleeve to said lower part of said sleeve, and second fixing means for detachably fixing said lower part of said sleeve in engagement with said stopper such that when said upper part of said sleeve is removed from its position surrounding at least part of said stopper and detached from said lower part of said sleeve, said lower part of said sleeve remains fixed to said stopper by said second fixing means and when said stopper means is removed from engagement with said lower part of said sleeve, said lower part of said sleeve remains affixed to the bottle.

17. The sleeve of claim 16, further comprising detachment means for detaching said upper part of said sleeve from said lower part of said sleeve, said detachment means comprising a plurality of tabs forming an integral part of said upper part of said sleeve, each of said tabs constituting a pair of spaced tear lines such that said tab is defined between said tear lines.

18. The sleeve of claim 16, wherein said first fixing means comprise a perforated tear line situated at an interface point between said lower part of said sleeve and said upper part of said sleeve.

19. The sleeve of claim 16, wherein said second fixing means comprise an inner ring situated at an interface point between said lower part of said sleeve and said upper part of said sleeve.

20. The sleeve of claim 19, wherein said stopper has one open end, an opposed end for closing the bottle, and a lower cylindrical rim, said inner ring having a cylindrical recess receivable of said lower rim.

* * * * *